US011697049B2

(12) United States Patent
Santos

(10) Patent No.: US 11,697,049 B2
(45) Date of Patent: Jul. 11, 2023

(54) GOLF BALL RETRIEVAL DEVICE

(71) Applicant: Vernie Santos, Happy Valley, OR (US)

(72) Inventor: Vernie Santos, Happy Valley, OR (US)

( * ) Notice: Subject to any disclaimer, the term of this patent is extended or adjusted under 35 U.S.C. 154(b) by 384 days.

(21) Appl. No.: 17/071,858

(22) Filed: Oct. 15, 2020

(65) Prior Publication Data

US 2021/0106882 A1 Apr. 15, 2021

Related U.S. Application Data

(63) Continuation-in-part of application No. 29/709,851, filed on Oct. 17, 2019, now Pat. No. Des. 954,869.

(60) Provisional application No. 62/915,165, filed on Oct. 15, 2019.

(51) Int. Cl.
*A63B 47/02* (2006.01)
*A63B 57/40* (2015.01)

(52) U.S. Cl.
CPC ..... *A63B 47/02* (2013.01); *A63B 57/40* (2015.10)

(58) Field of Classification Search
CPC .. A63B 47/02; A63B 57/40; A63B 2071/0694
See application file for complete search history.

(56) References Cited

U.S. PATENT DOCUMENTS 954,299 A * 4/1910 Johnson ..... A63B 63/06 D21/790
2,470,574 A * 5/1949 Nelson ..... A63B 57/10 473/394
2,900,318 A * 8/1959 Andrews ..... C25C 7/025 205/400
3,909,007 A * 9/1975 Wuertemburg ..... A63B 57/40 473/188
2009/0280919 A1* 11/2009 Prince ..... A63B 69/3676 473/409
2010/0022318 A1* 1/2010 Munaretto ..... A63B 57/40 473/196

* cited by examiner

*Primary Examiner* — Stephen A Vu

(57) ABSTRACT

A golf ball retrieval device which includes a receiver configured to be removably mounted to a golf pin. Further, a receiver body may be congruent to a counterweight of the golf pin. Further, the receiver indexes to the golf pin. Further, the golf ball retrieval device may include a collar comprising a hollow structure concentric to the receiver. Further, the collar may be configured to permit passage of the golf pin through the golf ball retrieval device. Further, the golf ball retrieval device may include an insertable grommet configured to enable a user to adapt the collar to fit the golf pin of a minimal diameter. Further, the golf ball retrieval device may include a platform comprising a surface protruding radially from a combined form of the collar and the receiver.

19 Claims, 14 Drawing Sheets

GOLF BALL RETRIEVAL DEVICE

The current application claims a priority to the U.S. Provisional Patent application Ser. No. 62/915,165 filed on Oct. 15, 2019.

FIELD OF THE INVENTION

Generally, the present disclosure relates to the field of sports equipment. More specifically, the present disclosure relates to golf ball retrieval devices.

BACKGROUND OF THE INVENTION

Until recently, rules provided by the United States Golf Association (USGA) stipulated that a pin (referring to the flag, shaft, and counterweight be removed from a cup (the rigid cylindrical insert forming the hole) before attempts to putt on a green were made. Failure to do so would subject the player to a two-stroke penalty. This penalty, or specifically avoidance thereof, required players interested in games abiding by official rules to remove and replace the pin multiple times for every hole played. Though apparently a minor inconvenience, this requirement accumulates over an eighteen-hole course to represent a significant delay in play, especially without a dedicated caddy on-hand to service the pin as necessary. In recognition of this, the USGA has recently authorized players to attempt putts from the green, with the pin in the cup, at no penalty. This upset in the previous order has already resulted in a change in strategy from at least one professional golfer, signaling a shift in technique and opening a field of new possible styles involving the use of the pin as an element of play.

However, the players themselves may now prove to be an impediment to their own timely rounds of golf—the repeated removal of a ball from a cup with the pin in-place is known to deform the surrounding sections of the green, even lifting the cup partially out of position and raising a dome of earth around the aperture of the hole. This damage to the course is recognized as unacceptable to discerning players, and costly to course operators. Groundskeepers, and the expenses associated with their profession, already represent a significant portion of the operating costs for a given course. Additional corrective landscaping, combined with the necessary downtime for a given hole, may impede play as much as the pin-in requirement prior to the rule change. It is therefore recognized that the market demands a means of retrieving a player's ball from within the cup without requiring external tools, manual extraction, and by a means that will not substantially disrupt the playable qualities of a given course.

Therefore, there is a need for improved golf ball retrieval devices that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed is a golf ball retrieval device. The golf ball retrieval device may include a receiver configured to be removably mounted to a golf pin. Further, a receiver body may be congruent to a counterweight of the golf pin. Further, the receiver indexes to the golf pin. Further, the golf ball retrieval device may include a collar comprising a hollow structure concentric to the receiver. Further, the collar may be configured to permit passage of the golf pin through the golf ball retrieval device. Further, the golf ball retrieval device may include an insertable grommet configured to enable a user to adapt the collar to fit the golf pin of a minimal diameter. Further, the golf ball retrieval device may include a platform comprising a surface protruding radially from a combined form of the collar and the receiver. Further, the platform may be configured to substantially fill a cross-sectional area of a golf cup.

According to some embodiments, a golf ball retrieval device is disclosed. The golf ball retrieval device may include a receiver configured to be removably mounted to a golf pin. Further, a receiver body may be congruent to a counterweight of the golf pin. Further, the receiver indexes to the golf pin. Further, the golf ball retrieval device may include a collar comprising a hollow structure concentric to the receiver. Further, the collar may be configured to permit passage of the golf pin through the golf ball retrieval device. Further, the collar may include a ring comprising a rigid structural body. Further, the collar may include a first fastener comprising a threaded setscrew penetrating the collar to protrude into the inner diameter of the ring. Further, the collar may include at least one second fastener configured to directly and oppositely oppose the first fastener across the ring, thereby enabling the user to advance the first fastener and at least one second fastener in conjunction to mechanically fix the golf ball retrieval device to a shaft of the golf pin. Further, the golf ball retrieval device may include an insertable grommet configured to enable a user to adapt the collar to fit the golf pin of a minimal diameter. Further, the golf ball retrieval device may include a platform comprising a surface protruding radially from a combined form of the collar and the receiver. Further, the platform may be configured to substantially fill a cross-sectional area of a golf cup.

According to some embodiments, a golf ball retrieval device is disclosed. Further, the golf ball retrieval device may include a receiver configured to be removably mounted to a golf pin, wherein a receiver body is congruent to a counterweight of the golf pin, wherein the receiver indexes to the golf pin. Further, the golf ball retrieval device may include a collar comprising a hollow structure concentric to the receiver, wherein the collar is configured to permit passage of the golf pin through the golf ball retrieval device. Further, the collar may include a ring comprising a rigid structural body. Further, the collar may include a first fastener comprising a threaded setscrew penetrating the collar to protrude into the inner diameter of the ring. Further, the collar may include at least one second fastener configured to directly and oppositely oppose the first fastener across the ring, thereby enabling the user to advance the first fastener and at least one second fastener in conjunction to mechanically fix the golf ball retrieval device to a shaft of the golf pin. Further, the golf ball retrieval device may include an insertable grommet configured to enable a user to adapt the collar to fit the golf pin of a minimal diameter. Further, the golf ball retrieval device may include a platform comprising a surface protruding radially from a combined form of the collar and the receiver, wherein the platform is configured to substantially fill a cross-sectional area of a golf cup. Further, the platform may include a canopy comprising a rigid cantilevered surface extending outward from the collar to approximate an inner cross-sectional diameter of the golf cup. Further, the platform may include a perimeter wall comprising a raised band of material coextensive to an outer diameter of the canopy. Further, the platform may include a plurality of perforations.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
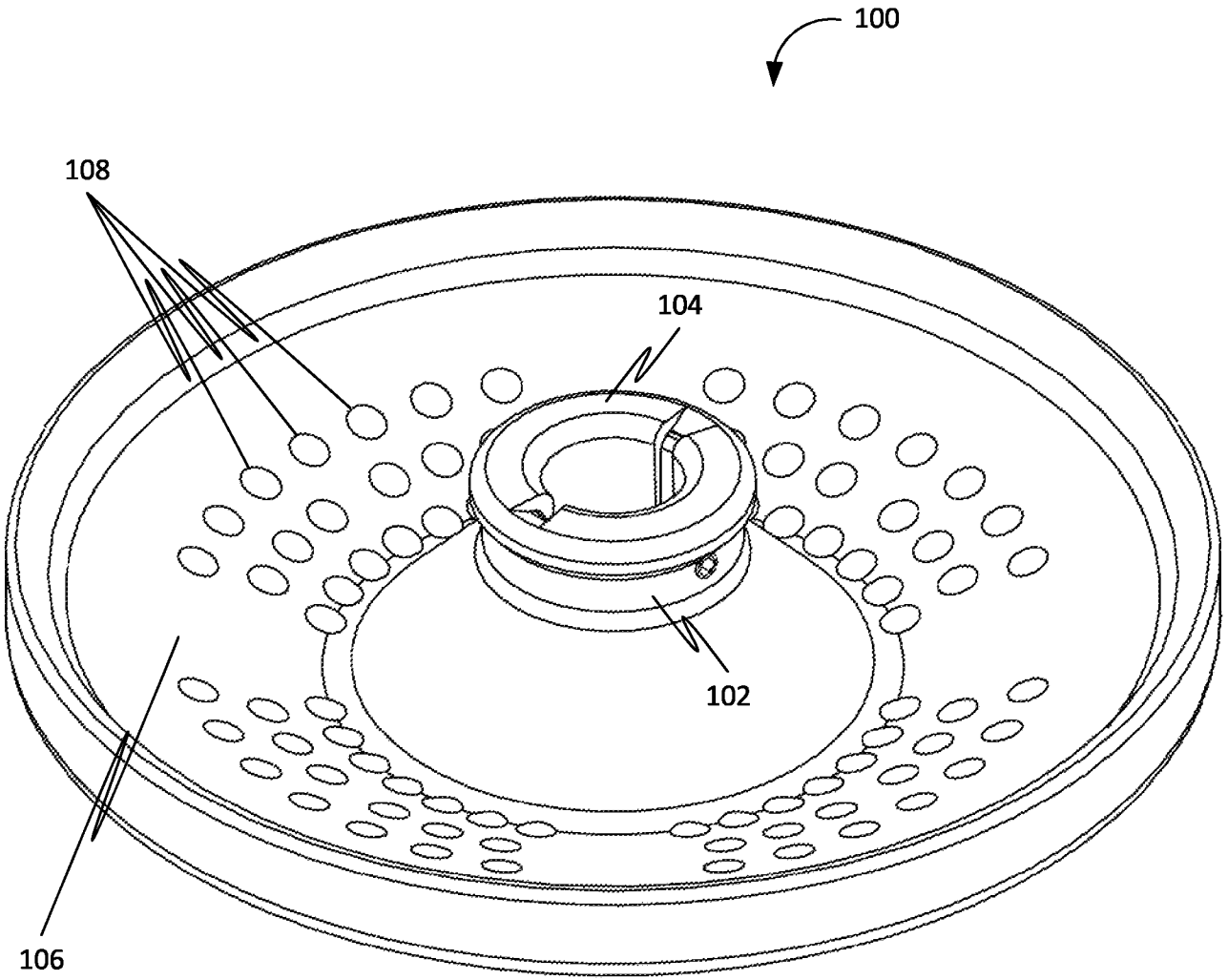
FIG. 1 is a top front perspective view of a golf ball retrieval device, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods.

Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of golf ball retrieval devices, embodiments of the present disclosure are not limited to use only in this context.

Overview:

The present disclosure relates generally to sporting equipment supporting an increase in efficiency and speed of play for rounds of golf. More specifically, the present disclosure provides a means for retrieving a standard golf ball from a standard cup without requiring a player to bend over to retrieve their ball.

Further, the present disclosure provides and enables a means to lift a player's ball clear of a cup after completion of a course of play via a non-permanent modification to standard pins, flagsticks, or similar entities associated with golf. Specifically, the present invention will create a retention structure for balls dropped into the cup fixed above a counterweight of the standard pin, providing players a means of retrieving their ball by simply lifting the pin clear of the hole once per round. The present invention is further contemplated to eliminate the requirement for players to carry external retrieval tools (graspers, suction cups, etc.) or to repeatedly bend over to continue play on a subsequent hole. Damages to the course green are additionally considered to be reduced by the elimination of the repeated removal and replacement of the pin, and the elimination of the use of external retrieval tools as previously mentioned. Further applications of the present invention may provide a medium for carrying advertisement or branding, depending on the locale and manufacturer specification of the individual iteration of the present invention to be described herein.

Further, the golf ball retrieval device comprises a receiver, a collar, an insertable grommet, and a platform. Further, the receiver defines a formation in the body of the golf ball retrieval device congruent to the counterweight of a standard golf pin, such that the receiver will index to the pin. In addition to providing a means of removably mounting the present invention to the pin, it is specifically contemplated that the protruding structure of the golf ball retrieval device may aide in supporting the pin and flag concentrically within the cup, preventing deflection of the pin in high winds or as a result of direct impact by the ball during regular play. The collar defines a hollow structure concentric to the receiver, suitable to permit passage of a standard pin through the golf ball retrieval device. The collar further comprises operable fixation components suitable for adapting the collar to fit a variety of pin diameters, ideally enabling a user to apply the golf ball retrieval device to any type or variety of pin as may be found under various standards or in various game types. The insertable grommet is further considered to enable a user to adapt the collar to fit pins of minimal diameter. In at least one embodiment, the collar may be built of an oversized internal diameter relative to the outer diameter of the pin such that the insertable grommet may occupy and fill any gap between the collar and the shaft of the pin. The platform defines a surface protruding radially from the combined form of the collar and the receiver, ideally of suitable dimensions to substantially fill a cross-sectional area of a standard golf cup. Specific consideration is given to the maximum lateral measurement of the platform being less than the minimum interior diameter of the cup, such that the golf ball retrieval device may freely traverse the depth of the cup without binding to the internal walls. Specific structures and contours of the platform are contemplated to permit the user to retain a golf ball on said platform when lifted by an associated pin. Further consideration is given to the establishment of drainage features to prevent rainwater or surface runoff from accumulating on the platform.

The collar further comprises a ring, a first fastener, and at least one second fastener. The ring defines the rigid structural body of the collar, providing a fixed position for both the first fastener and the second fastener to protrude therethrough. Further, the first fastener ideally defines a threaded setscrew penetrating the collar to protrude into the inner diameter of the ring. At least one second fastener is contemplated to directly and oppositely oppose the first fastener across the ring, thereby enabling the user to advance the first fastener and at least one second fastener in conjunction to mechanically fix the golf ball retrieval device to the shaft of any pin. In alternate embodiments, the first fastener and at least one second fastener may comprise any type or variety of operable fixation device or assembly without departing from the original scope and spirit of the present invention. Further, in one instance at least one second fastener may comprise a third fastener, wherein the first fastener, second fastener, and third fastener may be radially dispersed equidistant about the collar. Further additions of repeated instances of the third fastener are considered to be obvious to a reasonably skilled individual and should not be construed to limit the effective scope of the present invention.

Further, the insertable grommet comprises a retainer, a first leg, a second leg, and a radial taper. The retainer provides an arched connective structure between the first leg and the second leg, ideally formed to be congruent to the ring of the collar to cause minimal disruption to the overall shape of the installed golf ball retrieval device when fixed into position. The retainer may, in at least one alternate embodiment, define a separable body fixed independently to the first leg and the second leg. Further iterations may feature a releasable fixation function such that the first leg and the second leg may be operably detached and interchanged by a user. The first leg and the second leg comprise equal, opposing tapered structures coextensive to the retainer. In use, the first leg and the second leg will shim the gap between the shaft of a pin and the inner diameter of the collar, being fixed in position by the first fastener and the second fastener. The radial taper enables the partial insertion of the insertable grommet into the collar, establishing a variable inner and outer diameter at an arbitrary lateral plane dependent on the offset of the retainer to the collar.

Further, the platform defines a canopy, a perimeter wall, and a plurality of perforations. The canopy defines a rigid cantilevered surface extending outward from the collar to approximate the inner cross-sectional diameter of the standard cup. The canopy features a series of drainage apertures, defined by the plurality of perforations, suitable for preventing the accumulation of water or debris onto the upward-facing portions of the canopy. It is contemplated that, in various alternate embodiments, the plurality of perforations and the structure of the canopy may be conformed to recognizable or marketable icons and branding, including the formation of the plurality of perforations into geometry recognizable within the field of sporting equipment specifically. The perimeter wall defines a raised band of material coextensive to the outer diameter of the canopy. The formation of the perimeter wall is positioned and formed such to prevent a golf ball from rolling off the canopy in the instance that a player removes the pin from a cup, thereby enabling the retrieval of a player's ball from the canopy. Avoidance of undue strain from repeated manual retrieval, in addition to the obsolescence of external retrieval devices, is contemplated to benefit players and course operators by enhancing the speed of play and eliminating the occurrence of damage to the cup or surrounding green.

Figure 2:
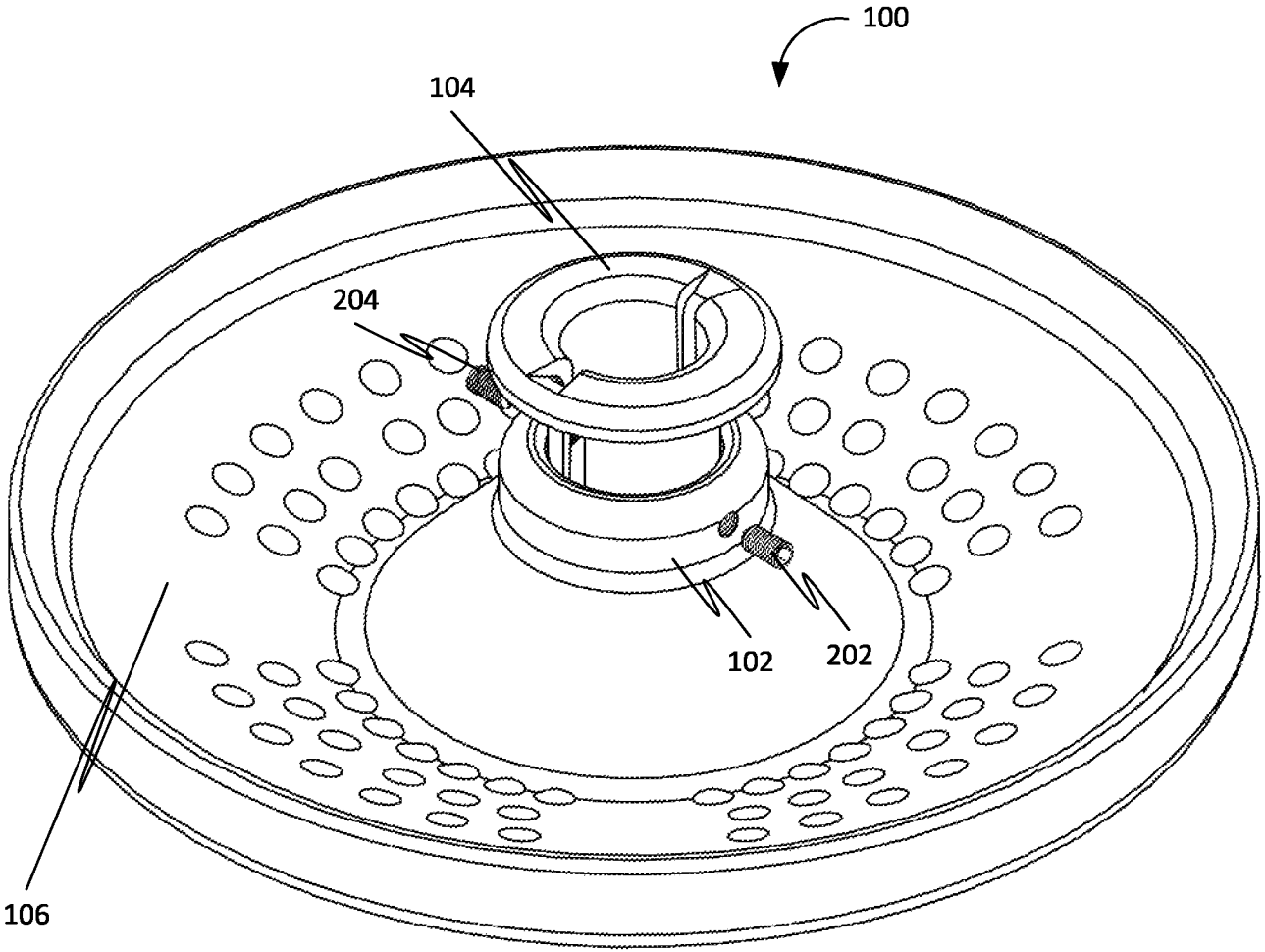
FIG. 2 is a top front perspective view of the golf ball retrieval device with fasteners removed, in accordance with some embodiments.
Figure 3:
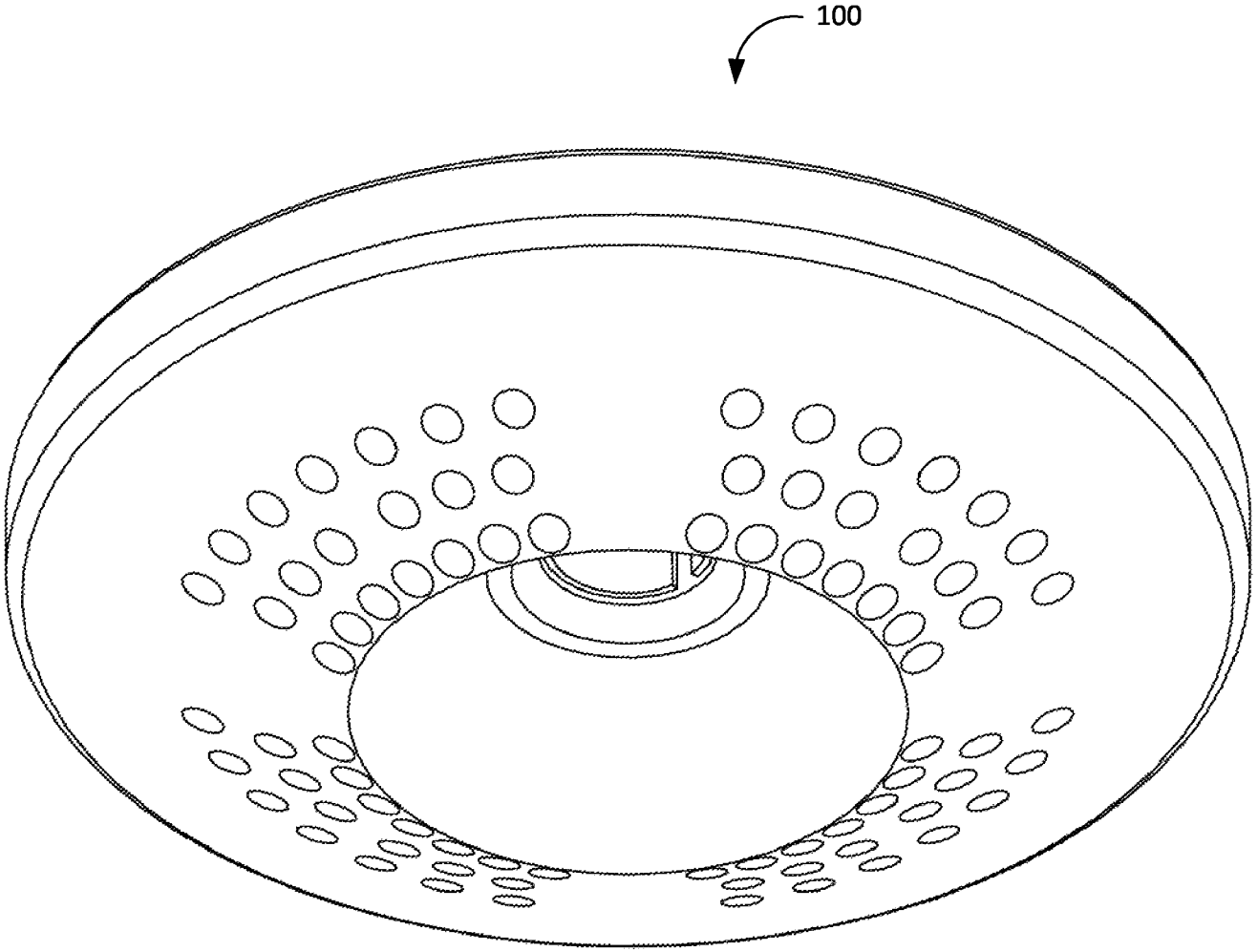
FIG. 3 is bottom front perspective view of the golf ball retrieval device, in accordance with some embodiments.
Figure 4:
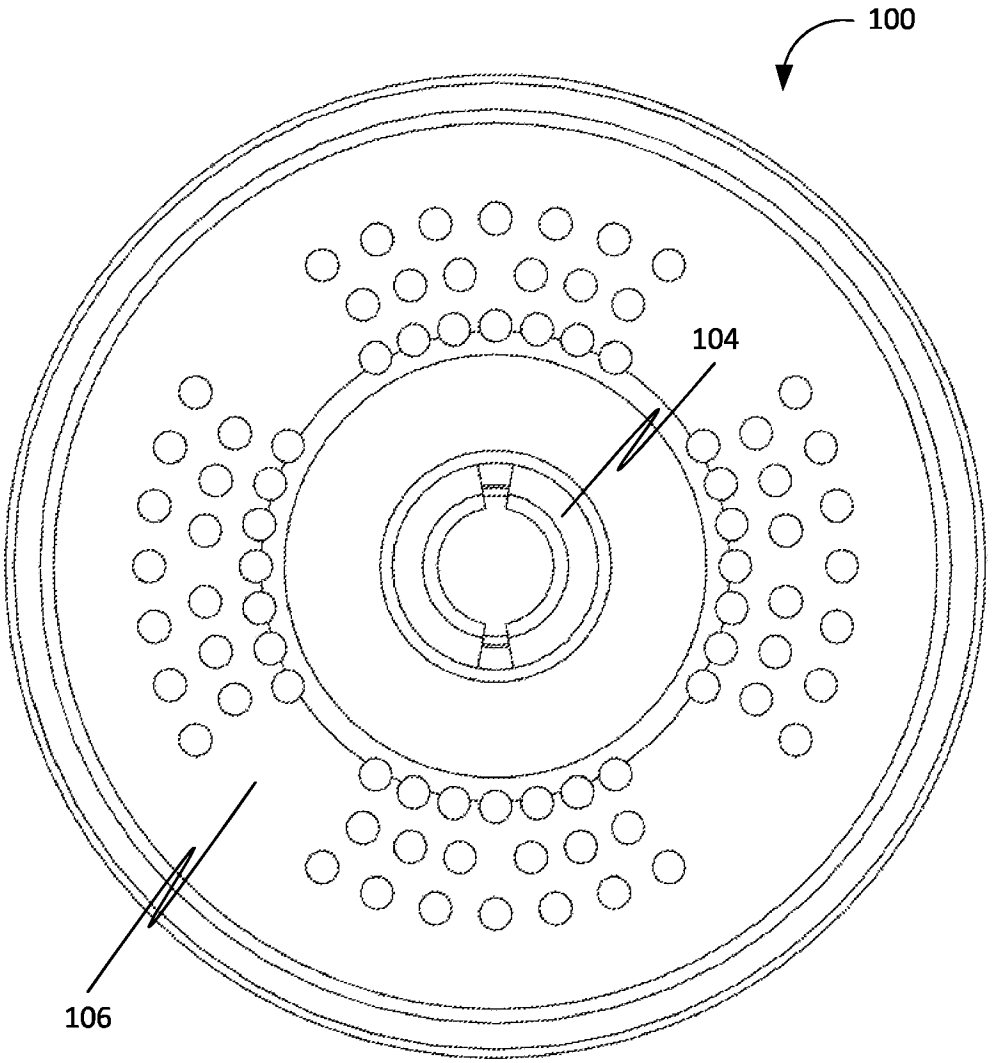
FIG. 4 is a top view of the golf ball retrieval device, in accordance with some embodiments.
Figure 5:
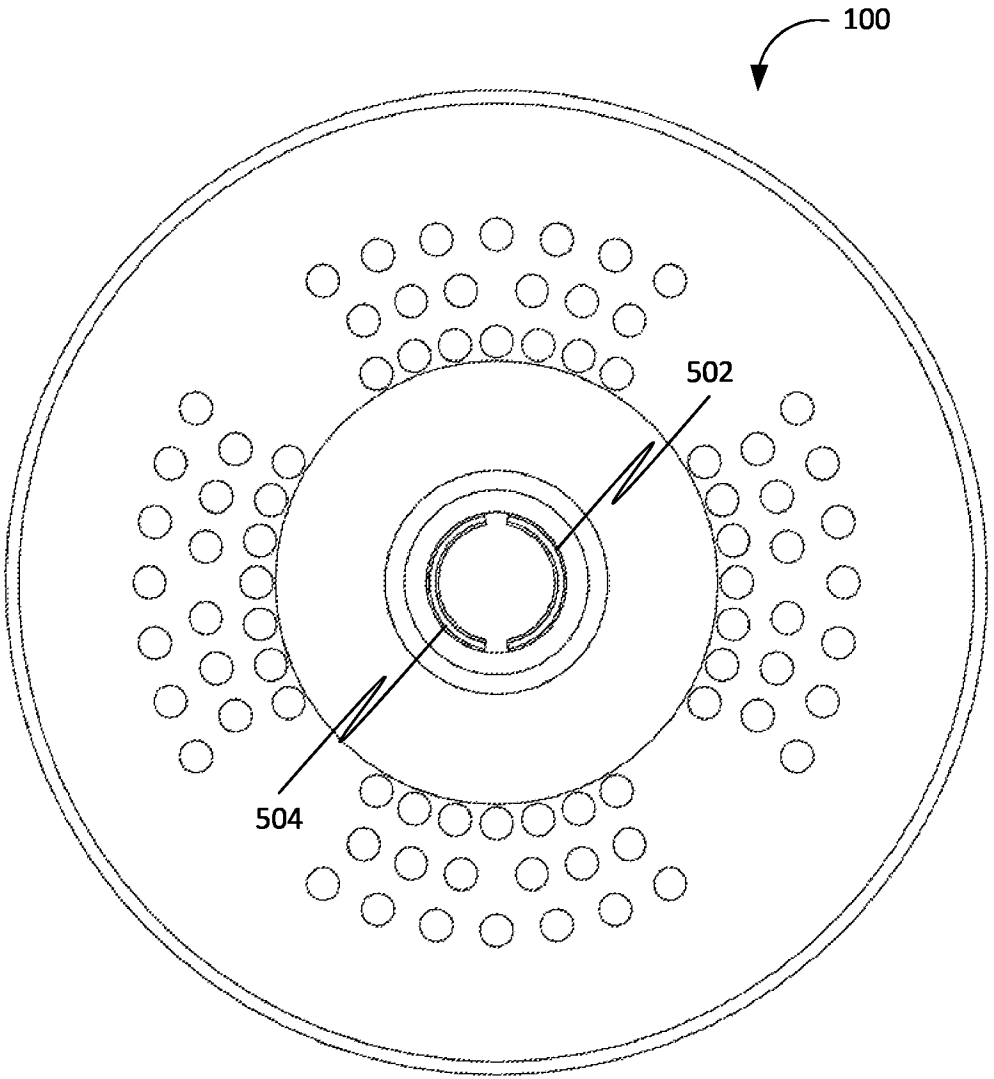
FIG. 5 is a bottom view of the golf ball retrieval device, in accordance with some embodiments.
Figure 6:
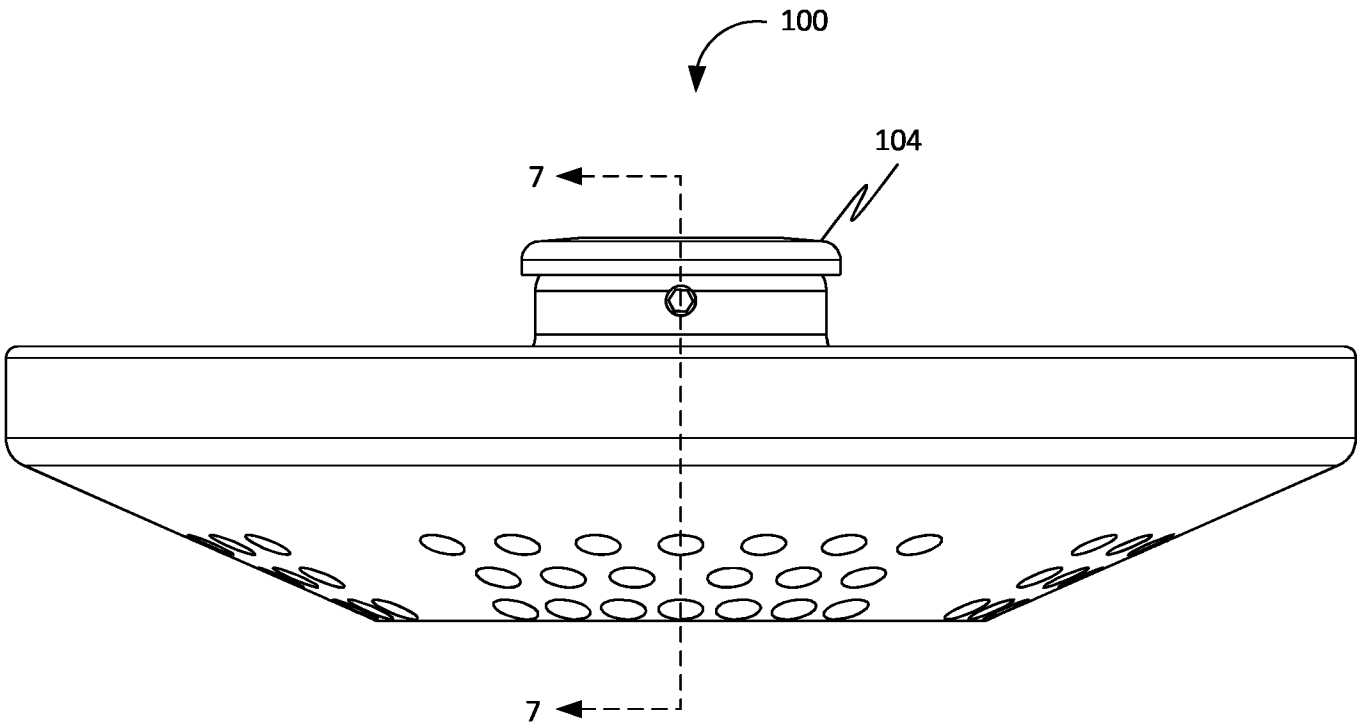
FIG. 6 left side view of the golf ball retrieval device, in accordance with some embodiments.

Referring now to figures, FIG. 1 is a top front perspective view of a golf ball retrieval device 100, in accordance with some embodiments. FIG. 2 is a top front perspective view of the golf ball retrieval device 100 with fasteners 202-204 removed, in accordance with some embodiments. FIG. 3 is bottom front perspective view of the golf ball retrieval device 100, in accordance with some embodiments. FIG. 4 is a top view of the golf ball retrieval device 100, in accordance with some embodiments. FIG. 5 is a bottom view of the golf ball retrieval device 100, in accordance with some embodiments. FIG. 6 left side view of the golf ball retrieval device 100, in accordance with some embodiments.

Figure 7:
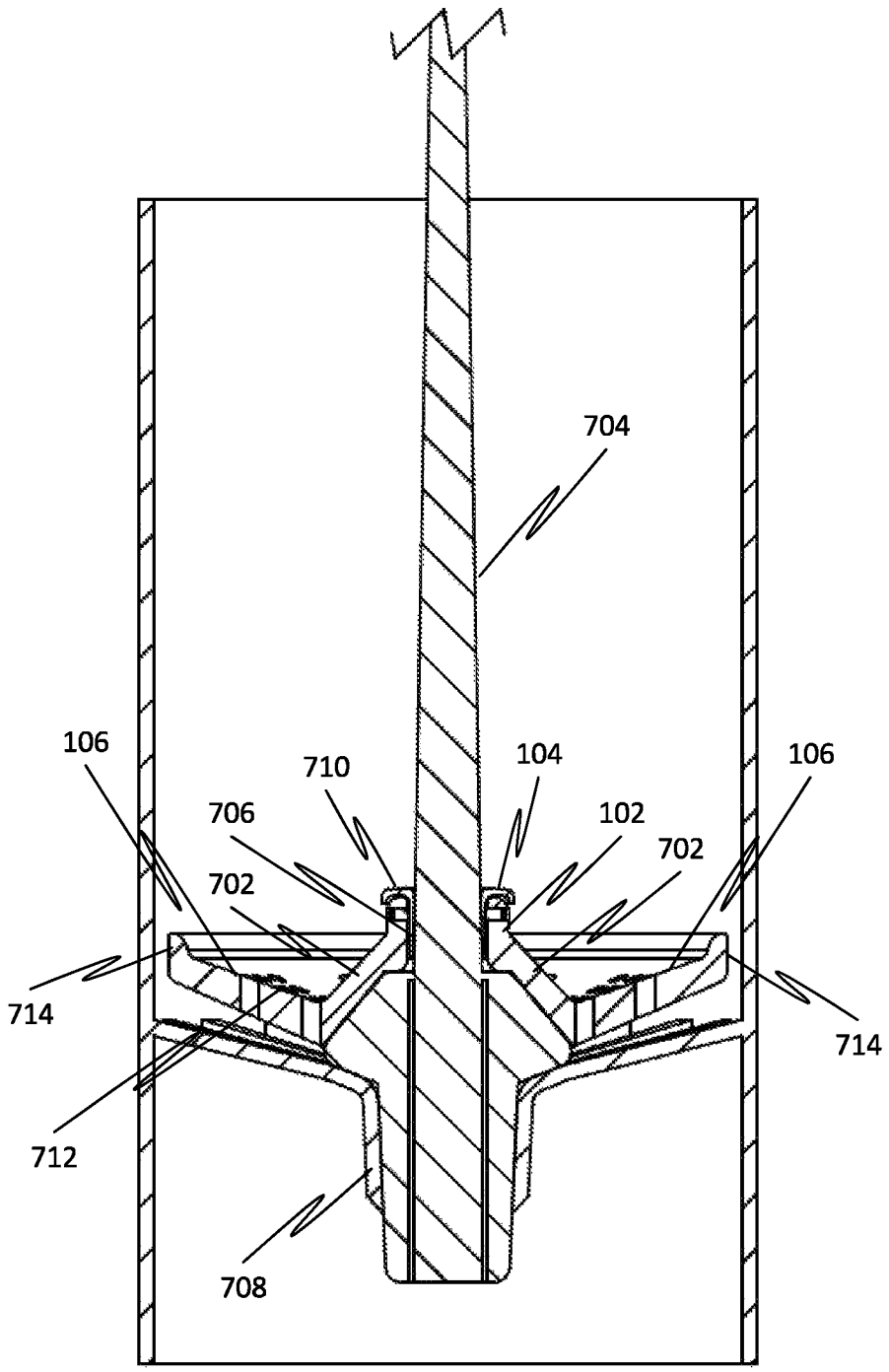
FIG. 7 is a cross section view taken along line 7-7 in FIG. 6, wherein the golf ball retrieval device is positioned within a standard golf cup fixed to a standard golf pin.
Figure 8:
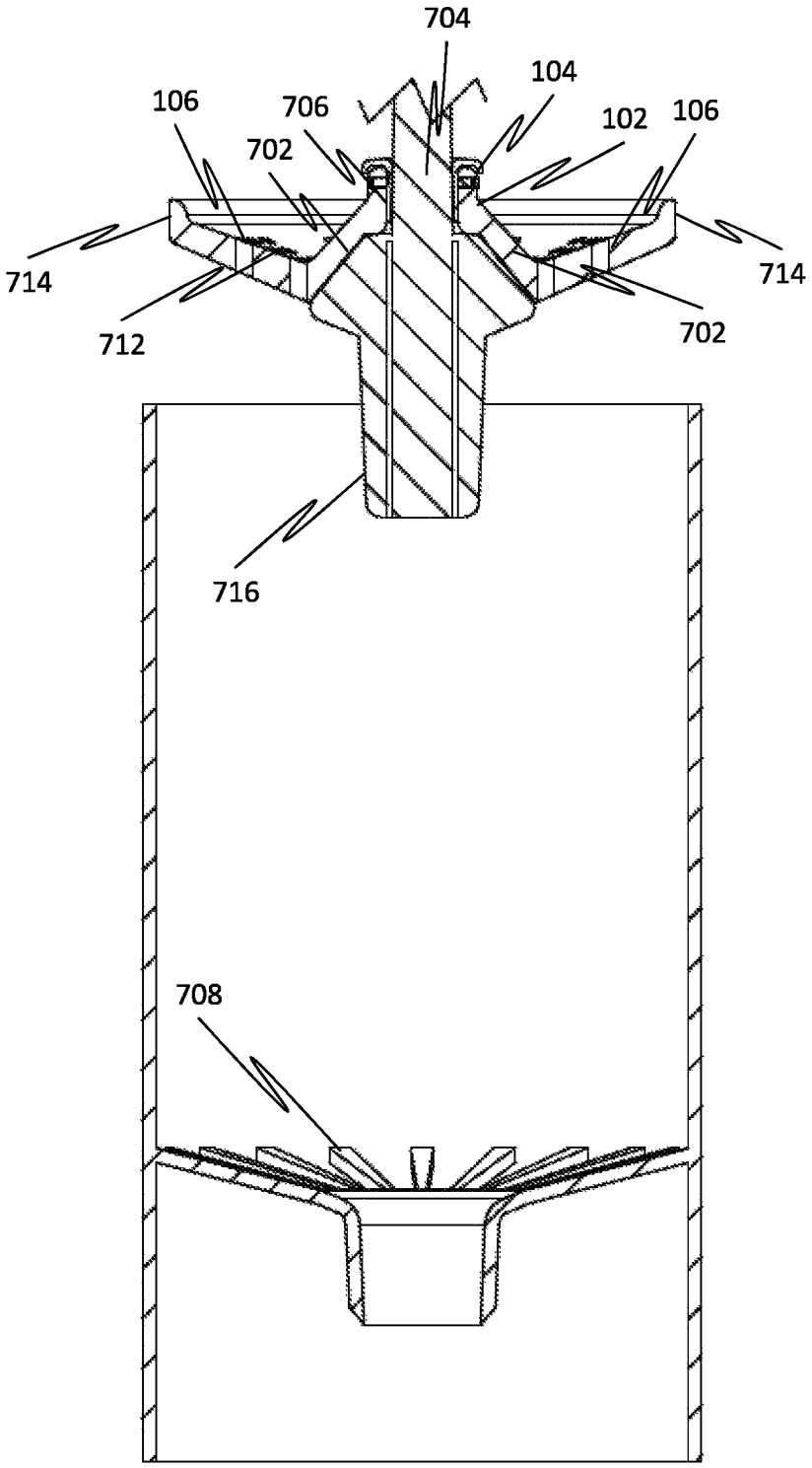
FIG. 8 is a cross section view taken along line 7-7 in FIG. 6, wherein the golf ball retrieval device is lifted clear of the standard golf cup while fixed to the standard golf pin.
Figure 9:
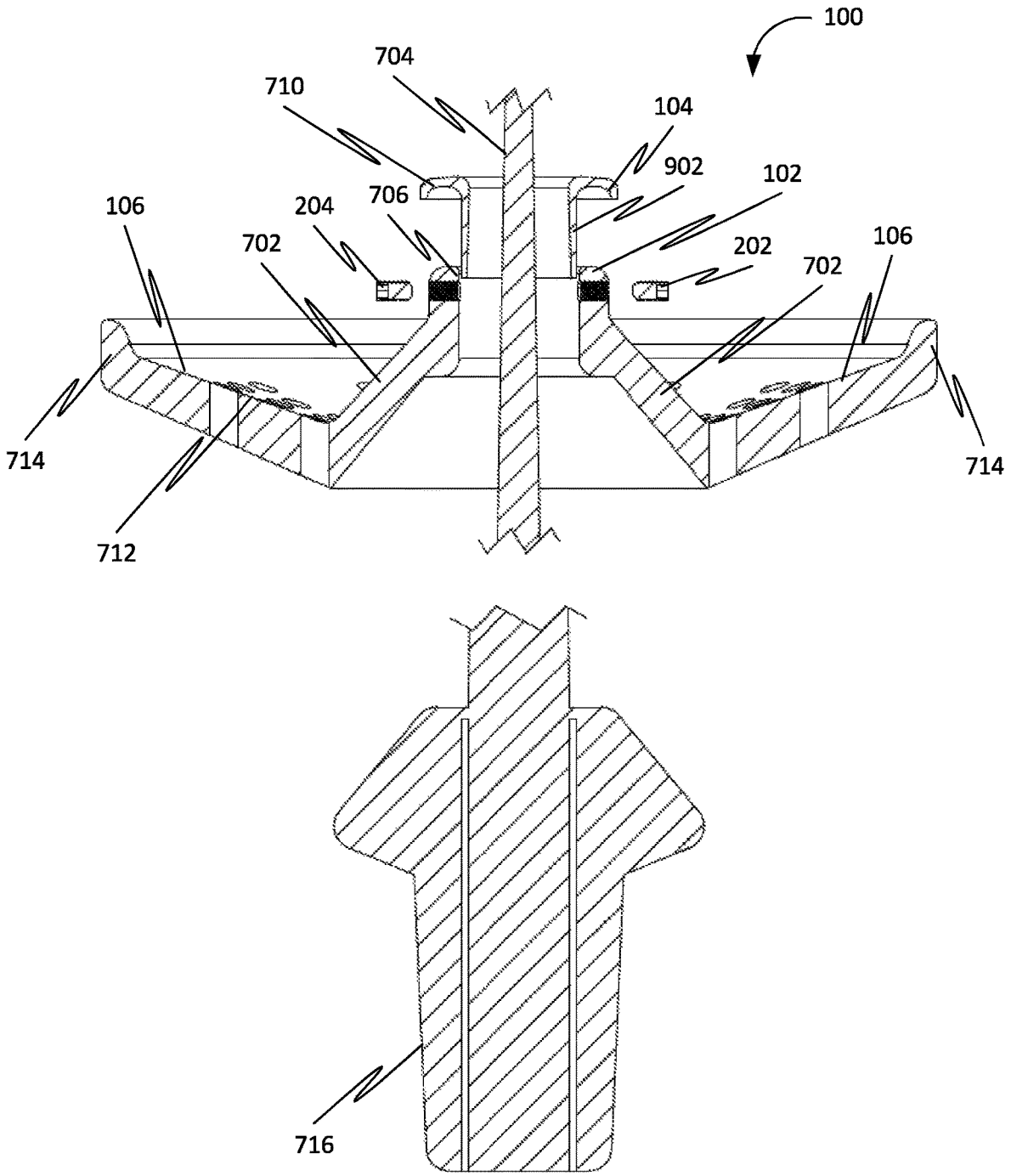
FIG. 9 is a cross section view taken along line 7-7 in FIG. 6, wherein the golf ball retrieval device is separated from the standard golf pin.

FIG. 7 is a cross section view taken along line 7-7 in FIG. 6, wherein the golf ball retrieval device 100 is positioned within a standard golf cup 708 fixed to a standard golf pin (such as a golf pin 704 shown in FIGS. 7-9). FIG. 8 is a cross section view taken along line 7-7 in FIG. 6, wherein the golf ball retrieval device 100 is lifted clear of the standard golf cup 708 while fixed to a standard golf pin (such as the golf pin 704). FIG. 9 is a cross section view taken along line 7-7 in FIG. 6, wherein the golf ball retrieval device 100 is separated from the standard golf pin (such as the golf pin 704).

Further, the golf ball retrieval device 100 may include a receiver 702 (shown in FIGS. 7-9) configured to be removably mounted to a golf pin (such as a golf pin 704 shown in FIGS. 7-9). Further, a body of the receiver 702 (receiver body) may be congruent to a counterweight 716 (shown in FIGS. 8-9) of the golf pin. Further, the receiver 702 indexes to the golf pin.

Further, the golf ball retrieval device 100 may include a collar 102 comprising a hollow structure concentric to the receiver 702. Further, the collar 102 may be configured to permit passage of the golf pin through the golf ball retrieval device 100.

In some embodiments, the collar 102 may include an operable fixation component configured for adapting the collar 102 to fit a plurality of pin diameters corresponding to a plurality of golf pins.

In some embodiments, the collar 102 may include a ring 706 comprising a rigid structural body. Further, the collar 102 may include a first fastener 202 (shown in FIG. 2) comprising a threaded setscrew penetrating the collar 102 to protrude into the inner diameter of the ring 706. Further, the collar 102 may include at least one second fastener 204 (shown in FIG. 2) configured to directly and oppositely oppose the first fastener across the ring 706, thereby enabling the user to advance the first fastener and at least one second fastener 204 (shown in FIG. 2) in conjunction to mechanically fix the golf ball retrieval device 100 to a shaft of the golf pin.

In Further embodiments, the at least one second fastener 204 may include a third fastener. Further, the first fastener 202, a second fastener and the third fastener may be radially dispersed equidistant about the collar 102.

Further, the golf ball retrieval device 100 may include an insertable grommet 104 configured to enable a user to adapt the collar 102 to fit the golf pin of a minimal diameter.

Further, the insertable grommet 104 may include a retainer 710 (shown in FIG. 7 and FIG. 9) comprising an arched connective structure congruent to the ring 706 of the collar 102 to cause minimal disruption to an overall shape of the golf ball retrieval device 100 when installed.

Further, the insertable grommet 104 may include a first leg 502 (shown in FIG. 5) attached to a first end of the arched connective structure.

Further, the insertable grommet 104 may include a second leg 504 (shown in FIG. 5) attached to a second end of the arched connective structure. Further, each of the first leg 502 and the second leg 504 may include equal and opposing tapered structures coextensive to the retainer 710.

Further, the insertable grommet 104 may include a radial taper 902 (shown in FIG. 9) configured to enable partial insertion of the insertable grommet 104 into the collar 102, establishing a variable inner and outer diameter at an arbitrary lateral plane dependent on an offset of the retainer 710 to the collar 102.

In some embodiments, the retainer 710 may include a separable body configured to be fixed independently to the first leg 502 and the second leg 504.

In some embodiments, the retainer 710 may include a releasable fixation configured to enable the first leg 502 and the second leg 504 to be operably detached and interchanged by the user.

In some embodiments, the collar 102 may include an oversized internal diameter relative to an outer diameter of the golf pin. Further, the insertable grommet 104 may occupy and fill any gap between the collar 102 and a shaft of the golf pin.

Further, the golf ball retrieval device 100 may include a platform 106 comprising a surface protruding radially from a combined form of the collar 102 and the receiver 702. Further, the platform 106 may be configured to substantially fill a cross-sectional area of a golf cup 708 (shown in FIGS. 7-8).

Further, a maximum lateral measurement of the platform 106 may be less than a minimum interior diameter of the golf cup 708. Further, the golf ball retrieval device 100 freely traverses the depth of the golf cup 708 without binding to the internal walls.

Further, a structure and a contour of the platform 106 may be configured to permit the user to retain a golf ball on the platform 106 when the golf pin is lifted.

Further, the platform 106 may include drainage features 108 configured to prevent water from accumulating on the platform 106.

In some embodiments, the platform 106 may include a canopy 712 (shown in FIGS. 7-9) comprising a rigid cantilevered surface extending outward from the collar 102 to approximate an inner cross-sectional diameter of the golf cup 708.

Further, the platform 106 may include a perimeter wall 714 (shown in FIGS. 7-9) comprising a raised band of material coextensive to an outer diameter of the canopy 712.

Further, the platform 106 may include a plurality of perforations 108. In some embodiments, the canopy 712 may include the plurality of perforations 108 configured to prevent accumulation of at least one of water and debris onto an upward-facing portion of the canopy 712.

In some embodiments, the plurality of perforations 108 and a structure of the canopy 712 may be conformed to a recognizable icon, wherein the formation of the plurality of perforations 108 into a geometry recognizable within a field of sporting equipment.

In some embodiments, the perimeter wall 714 may be configured prevent a golf ball from rolling off the canopy 712 when a user removes the golf pin from the golf cup 708, thereby enabling retrieval of the golf ball from the canopy 712.

According to some embodiments, a golf ball retrieval device 100 is disclosed. The golf ball retrieval device 100 may include a receiver 702 (shown in FIGS. 7-9) configured to be removably mounted to a golf pin (such as a golf pin 704 shown in FIGS. 7-9). Further, a body of the receiver 702 (receiver body) may be congruent to a counterweight 716 (shown in FIGS. 8-9) of the golf pin. Further, the receiver 702 indexes to the golf pin.

Further, the golf ball retrieval device 100 may include a collar 102 comprising a hollow structure concentric to the receiver 702. Further, the collar 102 may be configured to permit passage of the golf pin through the golf ball retrieval device 100.

Further, the collar 102 may include a ring 706 comprising a rigid structural body. Further, the collar 102 may include a first fastener 202 comprising a threaded setscrew penetrating the collar 102 to protrude into the inner diameter of the ring 706. Further, the collar 102 may include at least one second fastener 204 configured to directly and oppositely oppose the first fastener 202 across the ring 706, thereby enabling the user to advance the first fastener 202 and at least one second fastener 204 in conjunction to mechanically fix the golf ball retrieval device 100 to a shaft of the golf pin.

Further, the golf ball retrieval device 100 may include an insertable grommet 104 configured to enable a user to adapt the collar 102 to fit the golf pin of a minimal diameter.

Further, the insertable grommet 104 may include a retainer 710 (shown in FIG. 7 and FIG. 9) comprising an arched connective structure congruent to the ring 706 of the collar 102 to cause minimal disruption to an overall shape of the golf ball retrieval device 100 when installed.

Further, the insertable grommet 104 may include a first leg 502 (shown in FIG. 5) attached to a first end of the arched connective structure.

Further, the insertable grommet 104 may include a second leg 504 (shown in FIG. 5) attached to a second end of the arched connective structure. Further, each of the first leg 502 and the second leg 504 may include equal and opposing tapered structures coextensive to the retainer 710.

Further, the insertable grommet 104 may include a radial taper 902 (shown in FIG. 9) configured to enable partial insertion of the insertable grommet 104 into the collar 102, establishing a variable inner and outer diameter at an arbitrary lateral plane dependent on an offset of the retainer 710 to the collar 102.

Further, the retainer 710 may include a separable body configured to be fixed independently to the first leg 502 and the second leg 504.

Further, the retainer 710 may include a releasable fixation configured to enable the first leg 502 and the second leg 504 to be operably detached and interchanged by the user.

Further, the golf ball retrieval device 100 may include a platform 106 comprising a surface protruding radially from a combined form of the collar 102 and the receiver 702. Further, the platform 106 may be configured to substantially fill a cross-sectional area of a golf cup 708 (shown in FIGS. 7-8).

According to some embodiments, a golf ball retrieval device 100 is disclosed. Further, the golf ball retrieval device 100 may include a receiver 702 (shown in FIGS. 7-9) configured to be removably mounted to a golf pin (such as a golf pin 704 shown in FIGS. 7-9). Further, a body of the receiver 702 (receiver body) may be congruent to a counterweight 716 (shown in FIGS. 8-9) of the golf pin. Further, the receiver 702 indexes to the golf pin.

Further, the golf ball retrieval device 100 may include a collar 102 comprising a hollow structure concentric to the receiver 702. Further, the collar 102 may be configured to permit passage of the golf pin through the golf ball retrieval device 100.

Further, the collar 102 may include a ring 706 comprising a rigid structural body. Further, the collar 102 may include a first fastener 202 comprising a threaded setscrew penetrating the collar 102 to protrude into the inner diameter of the ring 706. Further, the collar 102 may include at least one second fastener 204 configured to directly and oppositely oppose the first fastener 202 across the ring 706, thereby enabling the user to advance the first fastener 202 and the at least one second fastener 204 in conjunction to mechanically fix the golf ball retrieval device 100 to a shaft of the golf pin.

Further, the golf ball retrieval device 100 may include an insertable grommet 104 configured to enable a user to adapt the collar 102 to fit the golf pin of a minimal diameter.

Further, the golf ball retrieval device 100 may include a platform 106 comprising a surface protruding radially from a combined form of the collar 102 and the receiver 702. Further, the platform 106 may be configured to substantially fill a cross-sectional area of a golf cup 708 (shown in FIGS. 7-8). Further, the platform 106 may include a canopy 712 (shown in FIGS. 7-9) comprising a rigid cantilevered surface extending outward from the collar 102 to approximate an inner cross-sectional diameter of the golf cup 708. Further, the platform 106 may include a perimeter wall 714 (shown in FIGS. 7-9) comprising a raised band of material coextensive to an outer diameter of the canopy 712. Further, the platform 106 may include a plurality of perforations 108.

Figure 10:
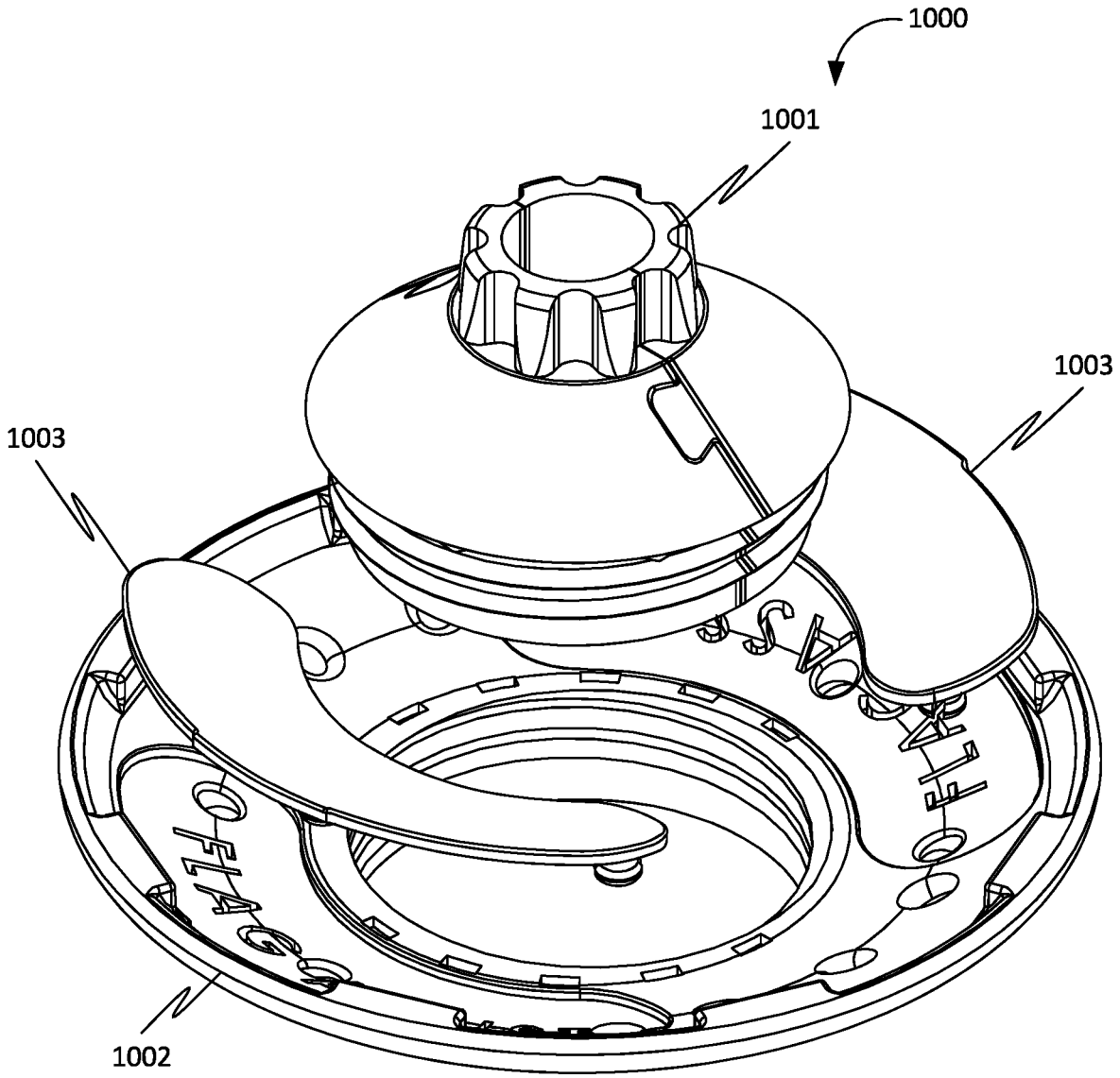
FIG. 10 is a top front perspective view of a golf ball retrieval device, in accordance with some embodiments.

FIG. 10 is a top front perspective view of a golf ball retrieval device 1000, in accordance with some embodiments. The golf ball retrieval device 1000 may include an Assy, split nut 1001; a cup, base, flag assist 1002; an insert, blank 1003 and a split O-ring, 1004 which may be a rubber grommet. In some embodiments, the split nut 1001 is split such that the split O-ring 1004 is able to facilitate gripping the golf pin. The split nut 1001 has a tapered thread that compresses the grommet 1004 around the golf pin when being attached to the flag assist 1002.

Figure 11:
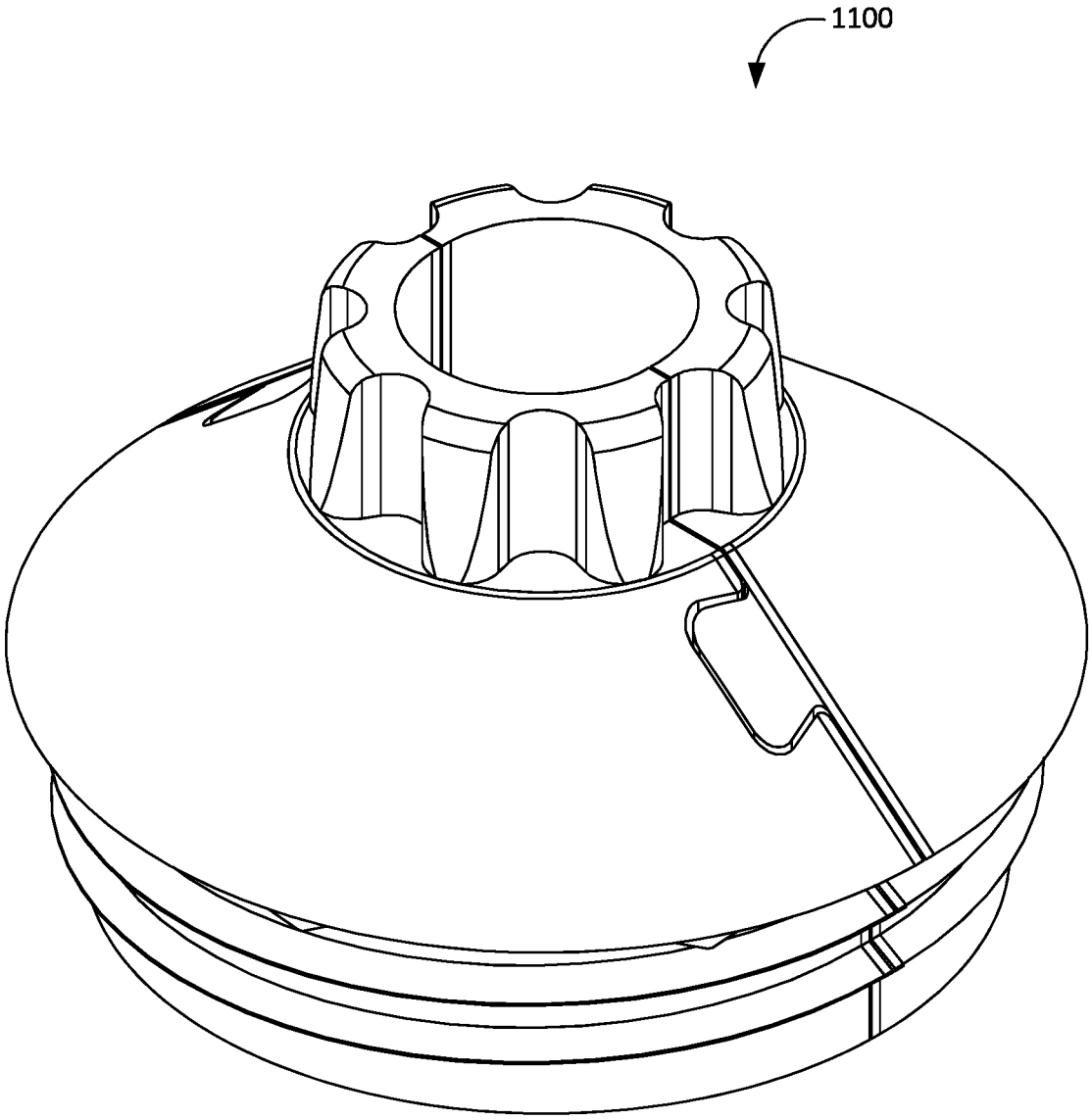
FIG. 11 is a top front perspective view of a nut assembly, flag assist, in accordance with some embodiments.
Figure 12:
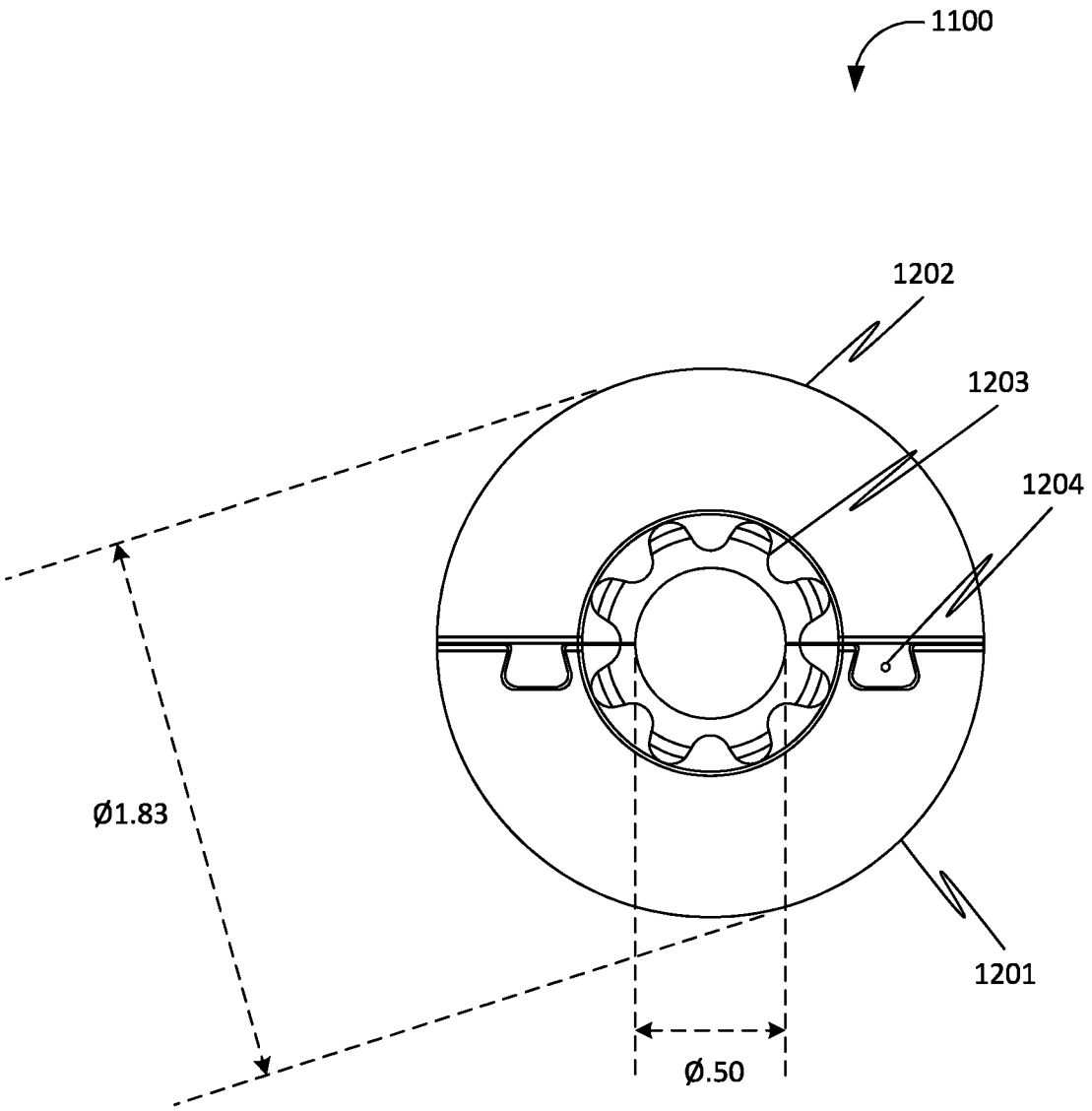
FIG. 12 is a top view of the nut assembly, flag assist.
Figure 13:
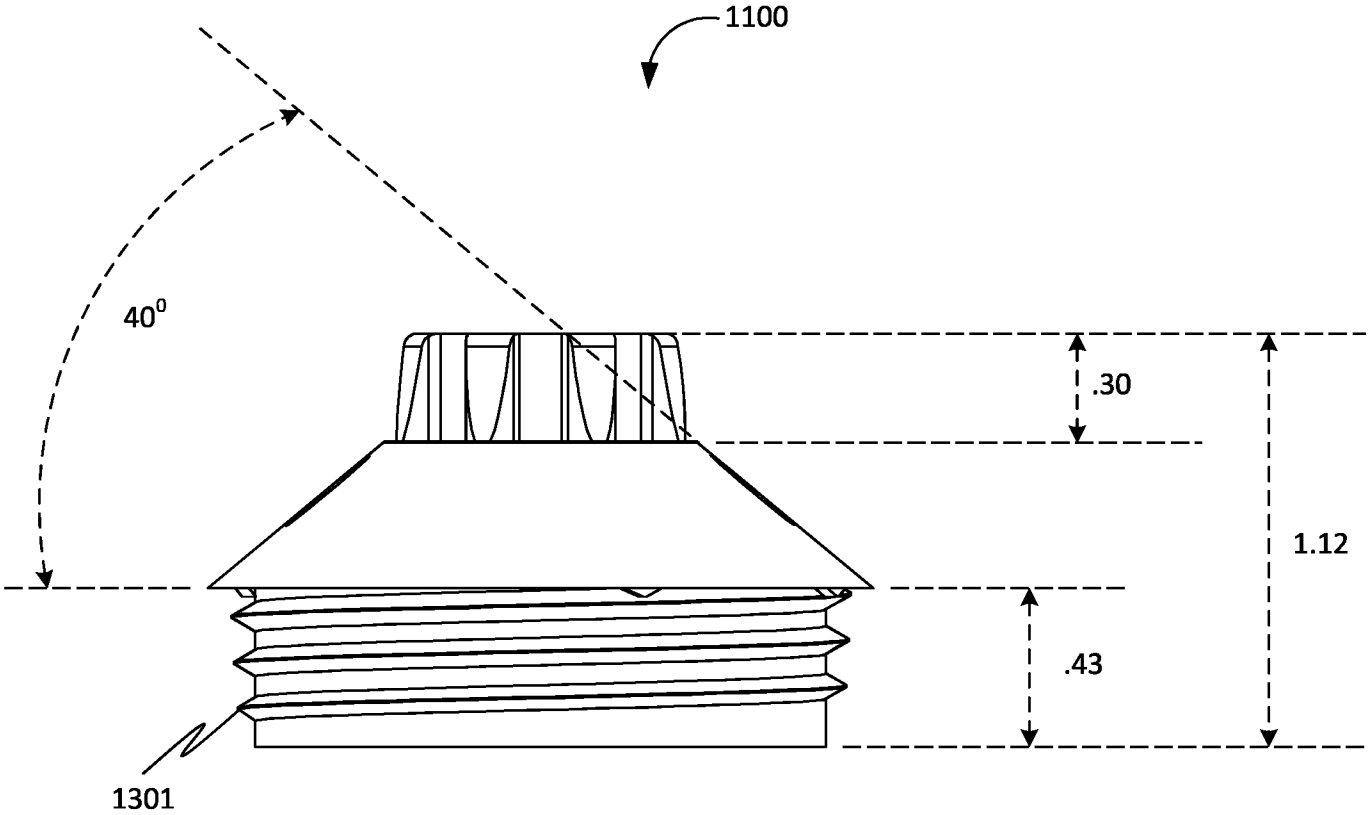
FIG. 13 is a side view of the nut assembly, flag assist.
Figure 14:
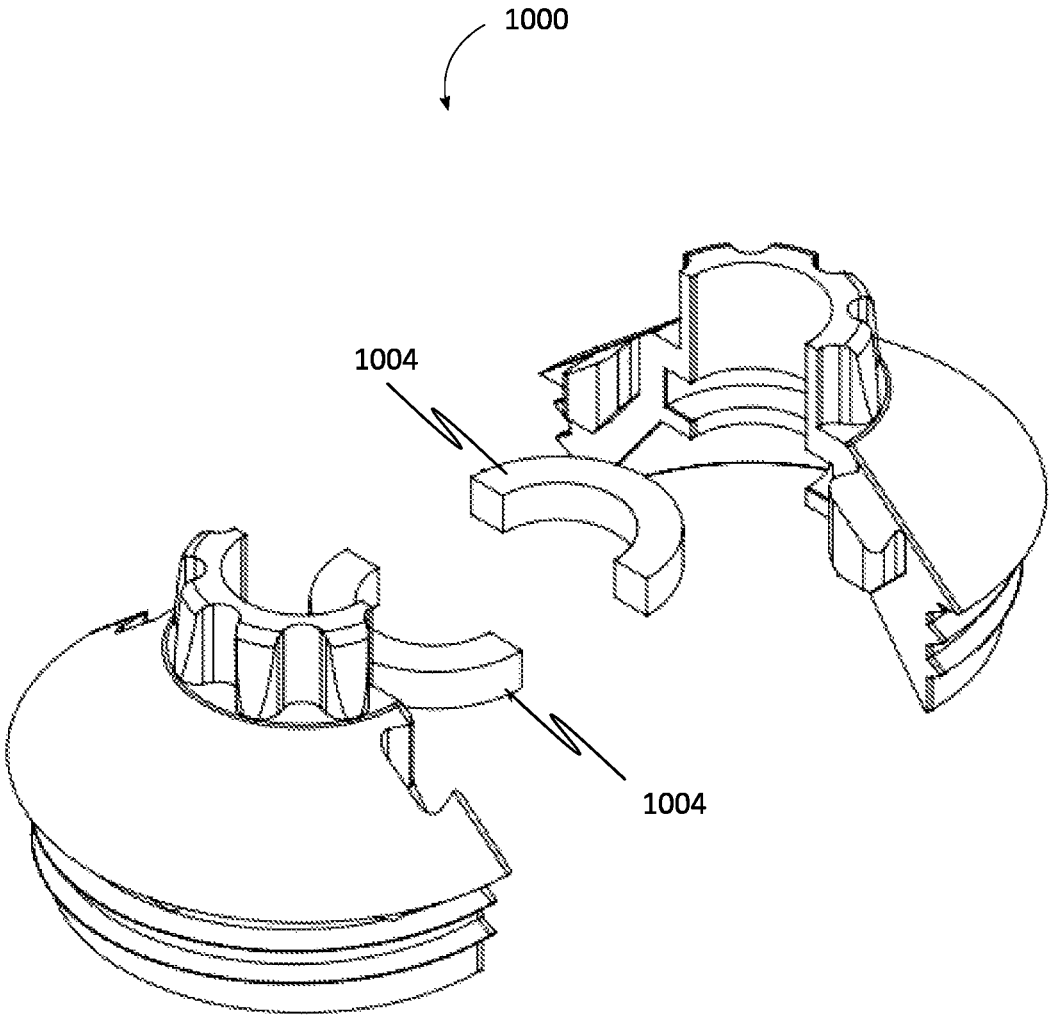
FIG. 14 is a top front perspective view of a nut assembly, flag assist, in accordance with some embodiments.

FIG. 11 is a top front perspective view of a nut assembly, flag assist 1100, in accordance with some embodiments. FIG. 12 is a top view of the nut assembly, flag assist 1100. FIG. 13 is a side view of the nut assembly, flag assist 1100. FIG. 14 is a top front perspective view of a nut assembly, flag assist 1100, in accordance with some embodiments.

Further, the nut assembly, flag assist 1100 may include a female nut 1201 and a male nut 1202. Further, the nut assembly, flag assist 1100 may include a star nut feature 1203. Further, the nut assembly, flag assist 1100 may include two or more dovetails 1204. Further, the nut assembly, flag assist 1100 may include thread 1301.

Further, FIGS. 12 and 13 show dimensions of various components. The dimensions may be in inches [mm].

Although the present disclosure has been explained in relation to its preferred embodiment, it is to be understood that many other possible modifications and variations can be made without departing from the spirit and scope of the disclosure.

What is claimed is:

1. A golf ball retrieval device comprising:

a receiver configured to be removably mounted to a golf pin, wherein a receiver body is congruent to a counterweight of the golf pin, wherein the receiver indexes to the golf pin;

a collar comprising a hollow structure concentric to the receiver, wherein the collar is configured to permit passage of the golf pin through the golf ball retrieval device;

an insertable grommet configured to enable a user to adapt the collar to fit the golf pin of a minimal diameter;

a platform comprising a surface protruding radially from a combined form of the collar and the receiver, wherein the platform is configured to substantially fill a cross-sectional area of a golf cup;

wherein the golf cup has a depth;

wherein the collar further comprises an operable fixation component configured for adapting the collar to fit a plurality of pin diameters corresponding to a plurality of golf pins.

2. The golf ball retrieval device of claim 1, wherein the collar comprises an oversized internal diameter relative to an outer diameter of the golf pin, wherein the insertable grommet occupies and fills any gap between the collar and a shaft of the golf pin.

3. The golf ball retrieval device of claim 1, wherein a maximum lateral measurement of the platform is less than a minimum interior diameter of the golf cup, wherein the golf ball retrieval device freely traverses the depth of the golf cup without binding to an internal wall.

4. The golf ball retrieval device of claim 1, wherein a structure and a contour of the platform are configured to permit the user to retain a golf ball on the platform when the golf pin is lifted.

5. The golf ball retrieval device of claim 1, wherein the platform comprises drainage features configured to prevent water from accumulating on the platform.

6. The golf ball retrieval device of claim 1, wherein the collar further comprises:

a ring comprising a rigid structural body;

the ring comprising an inner diameter;

a first fastener comprising a threaded setscrew penetrating the collar to protrude into the inner diameter of the ring; and at least one second fastener configured to directly and oppositely oppose the first fastener across the ring, thereby enabling the user to advance the first fastener and at least one second fastener in conjunction to mechanically fix the golf ball retrieval device to a shaft of the golf pin.

7. The golf ball retrieval device of claim 6, wherein the at least one second fastener comprises a third fastener, wherein the first fastener, a second fastener and the third fastener may be radially dispersed equidistant about the collar.

8. The golf ball retrieval device of claim 6, wherein the insertable grommet comprises:

a retainer comprising an arched connective structure congruent to the ring of the collar to cause minimal disruption to an overall shape of the golf ball retrieval device when installed;

a first leg attached to a first end of the arched connective structure;

a second leg attached to a second end of the arched connective structure, wherein each of the first leg and the second leg comprise equal and opposing tapered structures coextensive to the retainer; and a radial taper configured to enable partial insertion of the insertable grommet into the collar, establishing a variable inner and outer diameter at an arbitrary lateral plane dependent on an offset of the retainer to the collar.

9. The golf ball retrieval device of claim 8, wherein the retainer comprises a separable body configured to be fixed independently to the first leg and the second leg.

10. The golf ball retrieval device of claim 9, wherein the retainer comprises a releasable fixation configured to enable the first leg and the second leg to be operably detached and interchanged by the user.

11. The golf ball retrieval device of claim 1, wherein the platform comprises:

a canopy comprising a rigid cantilevered surface extending outward from the collar to approximate an inner cross-sectional diameter of the golf cup;

a perimeter wall comprising a raised band of material coextensive to an outer diameter of the canopy; and a plurality of perforations.

12. The golf ball retrieval device of claim 11, wherein the perimeter wall is configured prevent a golf ball from rolling off the canopy when a user removes the golf pin from the golf cup, thereby enabling retrieval of the golf ball from the canopy.

13. The golf ball retrieval device of claim 1, wherein the canopy further comprises a plurality of perforations configured to prevent accumulation of at least one of water and debris onto an upward-facing portion of the canopy.

14. The golf ball retrieval device of claim 13, wherein the plurality of perforations and a structure of the canopy is conformed to a recognizable icon, wherein a formation of the plurality of perforations into a geometry recognizable within a field of sporting equipment.

15. A golf ball retrieval device comprising:

a receiver configured to be removably mounted to a golf pin, wherein a receiver body is congruent to a counterweight of the golf pin, wherein the receiver indexes to the golf pin;

a collar comprising a hollow structure concentric to the receiver, wherein the collar is configured to permit passage of the golf pin through the golf ball retrieval device, wherein the collar comprises:

a ring comprising a rigid structural body;

the ring comprising an inner diameter;

a first fastener comprising a threaded setscrew penetrating the collar to protrude into the inner diameter of the ring; and at least one second fastener configured to directly and oppositely oppose the first fastener across the ring, thereby enabling the user to advance the first fastener and at least one second fastener in conjunction to mechanically fix the golf ball retrieval device to a shaft of the golf pin;

an insertable grommet configured to enable a user to adapt the collar to fit the golf pin of a minimal diameter; and a platform comprising a surface protruding radially from a combined form of the collar and the receiver, wherein the platform is configured to substantially fill a cross-sectional area of a golf cup.

16. The golf ball retrieval device of claim 15, wherein the insertable grommet comprises:

a retainer comprising an arched connective structure congruent to the ring of the collar to cause minimal disruption to an overall shape of the golf ball retrieval device when installed;

a first leg attached to a first end of the arched connective structure;

a second leg attached to a second end of the arched connective structure, wherein each of the first leg and the second leg comprise equal and opposing tapered structures coextensive to the retainer; and a radial taper configured to enable partial insertion of the insertable grommet into the collar, establishing a variable inner and outer diameter at an arbitrary lateral plane dependent on an offset of the retainer to the collar.

17. The golf ball retrieval device of claim 16, wherein the retainer comprises a separable body configured to be fixed independently to the first leg and the second leg.

18. The golf ball retrieval device of claim 17, wherein the retainer comprises a releasable fixation configured to enable the first leg and the second leg to be operably detached and interchanged by the user.

19. A golf ball retrieval device comprising:

a receiver configured to be removably mounted to a golf pin, wherein a receiver body is congruent to a counterweight of the golf pin, wherein the receiver indexes to the golf pin;

a collar comprising a hollow structure concentric to the receiver, wherein the collar is configured to permit passage of the golf pin through the golf ball retrieval device, wherein the collar comprises:

a ring comprising a rigid structural body;

a first fastener comprising a threaded setscrew penetrating the collar to protrude into an inner diameter of the ring; and at least one second fastener configured to directly and oppositely oppose the first fastener across the ring, thereby enabling the user to advance the first fastener and at least one second fastener in conjunction to mechanically fix the golf ball retrieval device to a shaft of the golf pin;

an insertable grommet configured to enable a user to adapt the collar to fit the golf pin of a minimal diameter; and a platform comprising a surface protruding radially from a combined form of the collar and the receiver, wherein the platform is configured to substantially fill a cross-sectional area of a golf cup, wherein the platform comprises:

a canopy comprising a rigid cantilevered surface extending outward from the collar to approximate an inner cross-sectional diameter of the golf cup;

a perimeter wall comprising a raised band of material coextensive to an outer diameter of the canopy; and a plurality of perforations.

* * * * *